United States Patent [19]

Degen et al.

[11] 4,060,237

[45] Nov. 29, 1977

[54] SHEET POSITIONING MECHANISM FOR FEED TABLE OF A SHEET-FED PRINTING PRESS

[75] Inventors: Klaus Degen, Froschhausen; Herbert Herrmann, Hausen, both of Germany

[73] Assignee: Roland Offsetmaschinenfabrik Faber & Schleicher AG, Offenbach, Germany

[21] Appl. No.: 765,860

[22] Filed: Feb. 4, 1977

[30] Foreign Application Priority Data

Feb. 5, 1976 Germany ..... 2604379

[51] Int. Cl.[2] ..... B65H 9/14

[52] U.S. Cl. ..... 271/231; 271/237; 271/250

[58] Field of Search ..... 271/237, 236, 238, 250, 271/251, 252, 241, 234, 231, 230, 229, 226

[56] References Cited

U.S. PATENT DOCUMENTS

| | | | |
|---|---|---|---|
| 3,663,011 | 5/1972 | Mowry et al. | 271/236 |
| 3,754,755 | 8/1973 | Krochert | 271/236 |
| 3,908,986 | 9/1975 | Bleau | 271/236 X |

FOREIGN PATENT DOCUMENTS

| | | | |
|---|---|---|---|
| 617,605 | 8/1935 | Germany | 271/250 |

*Primary Examiner*—Bruce H. Stoner, Jr.
*Attorney, Agent, or Firm*—Leydig, Voit, Osann, Mayer & Holt

[57] ABSTRACT

A sheet positioning mechanism for the feed table of a sheet-fed printing press which includes a set of releasable front stops and a side guide, with a wiper adjacent the side guide, the wiper having a limited zone of action. The sheets are fed in a straight stream, in shingled relation, along the feed table, the stream being laterally spaced from the side guide and out of the zone of action. A pair of swingable suckers are provided near the front end of the table and laterally spaced below the sheet path, the suckers being swung forwardly in unison about an arcuate path synchronized with the arrival of the sheet to be positioned so that such sheet is transported both forwardly in the direction of the front stops and laterally from its position in the stream into the zone of action of the wiper so that the wiper acts exclusively on the sheet to be positioned without interference by the overlapped closely following sheet. The wiper acts sufficiently early and is preferably sufficiently rapid so that the sheet is moved against the side guide just prior to engagement of the sheet with the front stops.

10 Claims, 6 Drawing Figures

SHEET POSITIONING MECHANISM FOR FEED TABLE OF A SHEET-FED PRINTING PRESS

It is known to provide a feed table having a set of front stops, or guides, and a side guide, the sheets being carried in overlapped relation along the table into engagement with the front stops, and with each sheet being acted upon by a wiper to crowd it into engagement with the side guide for accurate positioning. The front stops are releaseable so that the positioned sheet may be nipped along its leading edge by a swingable gripper assembly serving, for example, to pass the sheet to the impression cylinder of a printing press. Front stops operated from below the table, that is to say in "covered" position, have been used successfully for many years but wiping devices operating in covered position have been a frequent source of difficulty in the practical operation of a press. One of the reasons for this is that the wiper cannot complete its function in the short space of time which exists before the arrival of the overlapped, closely following, sheet in the stream. To prevent interference by the following sheet it is suggested in German Pat. No. 2,063,818 that the sheet to be positioned be shifted laterally after the leading edge engages the front stops to provide clearance with respect to the overlapped sheet. It is, however, disadvantageous to drag a sheet laterally along the front stops.

In British Pat. No. 1,021,118 a sheet registering device is disclosed which includes a rotating apertured disc to which vacuum is applied and which is relied upon to urge a sheet into seated position both against a front stop and against a side guide. While this might seem to be a simple solution to the problem of sheet positioning, in practice it does not suffice since the sheet, being impositively engaged for movement in the two directions, may strike one of the surfaces before the other. If the sheet strikes the front stop first, such engagement inhibits any subsequent lateral motion of the sheet toward the side guide, and vice versa. Moreover, the arrangement shown in the British patent is not well suited for handling of sheets in shingled relation.

Accordingly, it is an object of the present invention to provide a sheet positioning mechanism for a sheet-fed printing press which is capable of successively positioning a series of closely shingled sheets fed across a feed table at a rapid rate. Indeed, it is an object to provide a sheet positioning mechanism which is highly reliable at maximum modern day press speeds.

It is a more specific object of the invention to provide a sheet positioning mechanism including a covered wiper means for urging a sheet toward a side guide, the wiper means having a limited zone of action, with means for displacing a sheet out of the stream and into the zone of action to preclude interference by the following sheet in the stream. Thus it is an object to provide a sheet positioning mechanism in which accurate setting of each sheet against the side guide is assured even where sheets are closely shingled.

It is another object of the present invention to provide a covered auxiliary transport device in the form of a pair of small diameter sucker heads mounted upon horizontally swingable arms which, in addition to transporting a sheet laterally from its position in the stream, serve to decelerate the sheet smoothly from conveyor speed into temporarily stationary position against the front stops.

It is a general object of the present invention to provide a sheet positioning mechanism having the above features and advantages but which is relatively simple and economical in construction, which is non-critical of adjustment and which is capable of operating reliably for long periods of time, and in the face of highest press speeds, without maintenance or readjustment.

Other objects and advantages of the invention will become apparent upon reading the attached description and upon reference to the drawings in which.

Figure 5A:
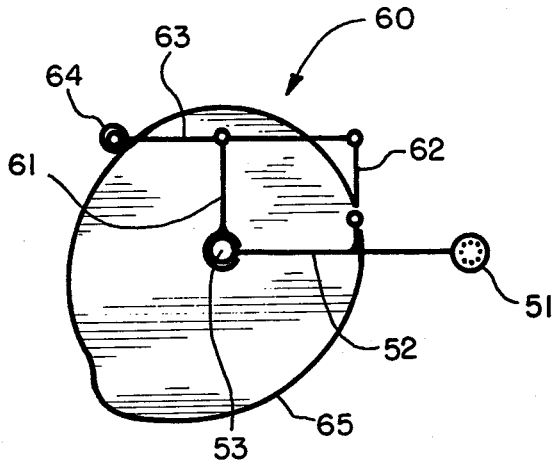
Figure 5B:
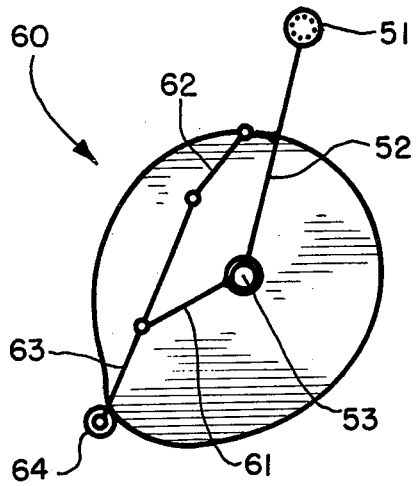

FIGS. 5*a* and 5*b* are diagrams showing a form of linkage which may be used for imparting orbital movement to the sucker heads.

While the invention has been described in connection with a preferred embodiment, it will be understood that we do not intend to be limited to the particular embodiment shown but intend, on the contrary, to cover the various alternative and equivalent constructions included within the spirit and scope of the appended claims.

Figure 1:
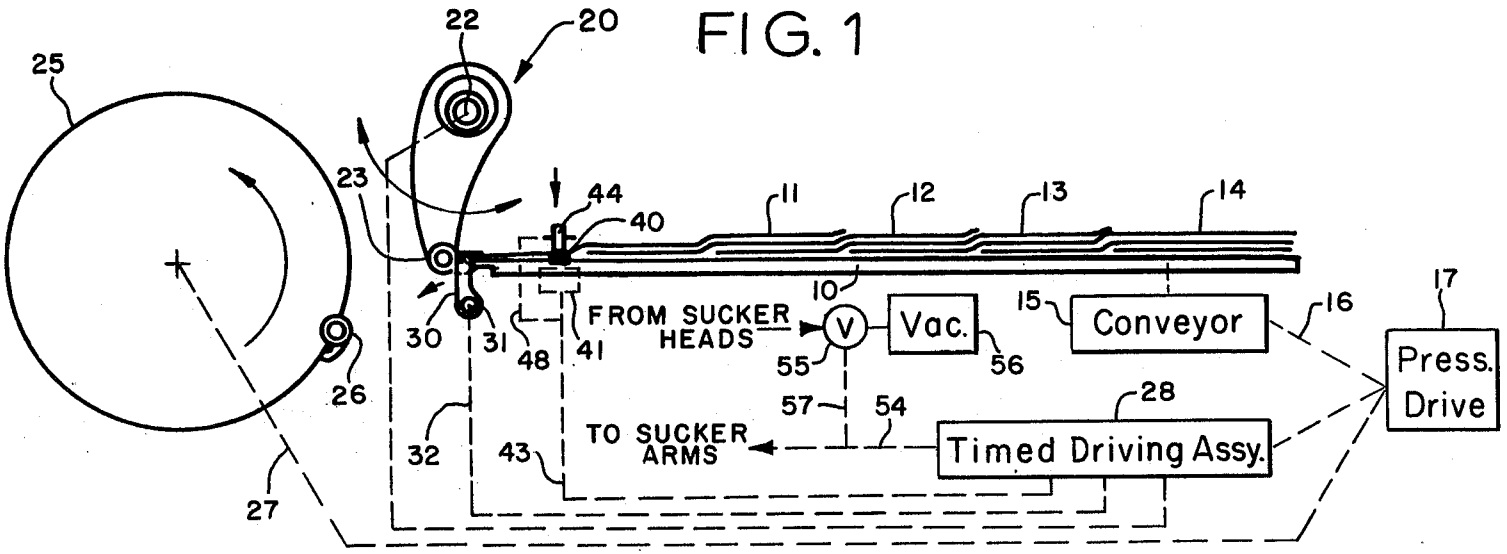
FIG. 1 is a simplified side elevation showing a feed table, swingable gripper, and impression cylinder, the feed table being equipped with positioning means constructed in accordance with the present invention.
Figure 3:
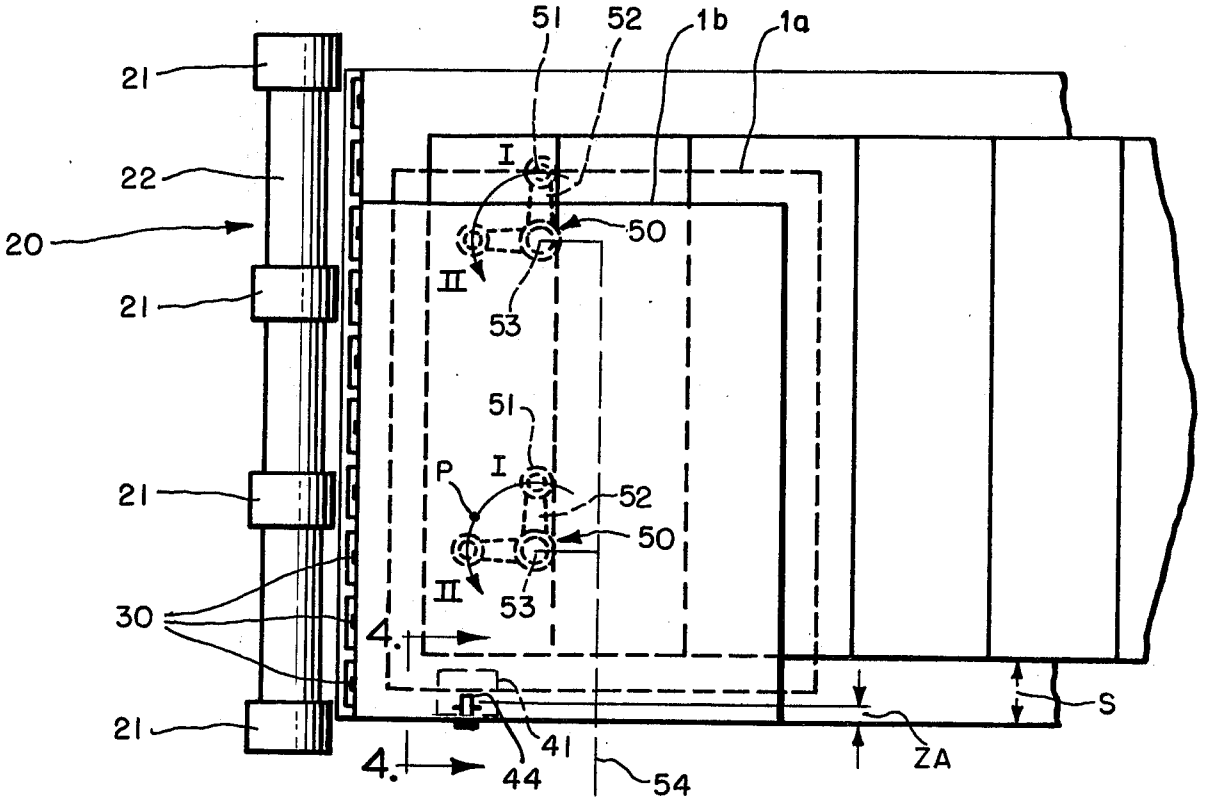
FIG. 3 is a simplified plan view based on FIG. 1.

Turning now to FIGS. 1 and 3 there is shown a feed table 10 along which is fed a stream of sheets in shingled relation, successive sheets being indicated at 11, 12, 13 and 14. The sheets are fed by means of a conveyor 15 which is shown only diagrammatically, since it is per se well known, and which may be formed of a set of laterally spaced belts recessed in the surface of the table and having a drive connection 16 to the driving mechanism 17 of the associated press. Typically the conveyor may operate at a speed up to 40 inches per second.

At the front edge of the table is a swingable gripper arm assembly 20 having arms 21 on a shaft 22, with a gripper 23 at the end of each arm for engaging the leading edge of the positioned sheet and for transferring the sheet from the table to a receiving device which may, for example, be in the form of an impression cylinder 25 having a set of grippers 26. The impression cylinder has a driving connection 27 with the press drive 17.

For the purpose of insuring synchronization of the gripper arms 21 with the rotation of the impression cylinder and with the other elements to be discussed, the gripper arm shaft is coupled to the press drive via a timed driving assembly 28. For the sake of simplicity, and since synchronization of driven elements to perform a press or feed table function is per se well known, the driving assembly 28 has been indicated diagrammatically, reference being made to prior patents for details.

For the purpose of arresting and positioning the front edge of a transported sheet for gripping by the grippers on the gripper arms 21, a set of front stops 30 are provided. These extend below table level and are mounted on a shaft 31 for rocking movement between the obstructing position illustrated in FIG. 1 and the released position shown in FIG. 2, the shaft 31 being connected to the timed driving assembly 28 via a suitable mechanical connection 32.

Figure 4:
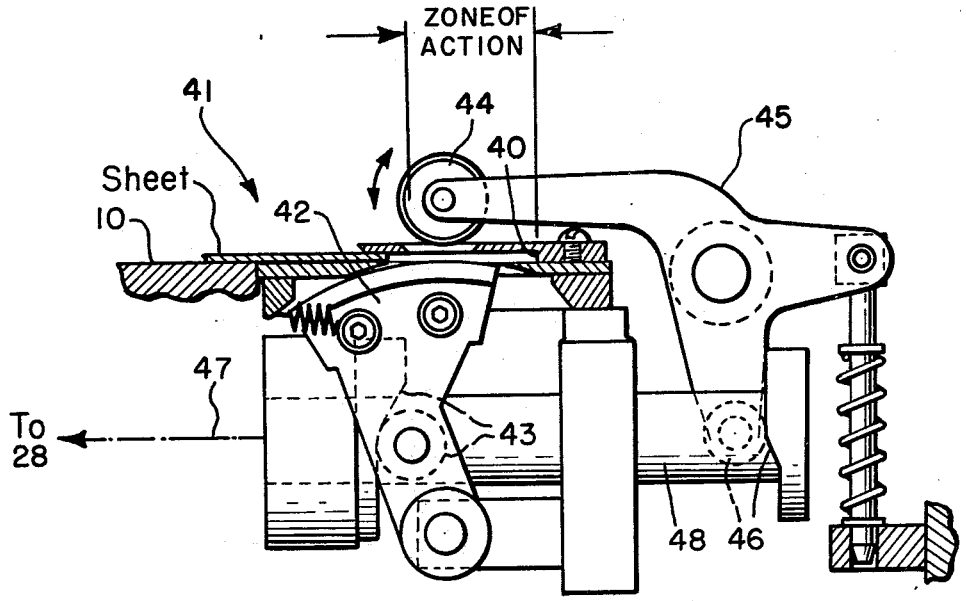
FIG. 4 is a fragmentary elevation taken along line 4—4 in FIG. 3.

To achieve lateral positioning of each sheet a side guide 40 is used. Arranged immediately adjacent, and below the level of the feeding surface, is a wiper mechanism 41 (see FIG. 4) for urging the sheet toward the side guide. Such a mechanism is per se conventional, as shown, for example, in U.S. patent application Ser. No. 711,581 filed Aug. 4, 1976, now U.S. Pat. No. 4,023,793. The mechanism includes a wiper member 42 presenting a frictional surface against the underside of the sheet and having means such as a cam and follower 43 for oscillating the same toward and away from the side guide. For pressing the sheet against the wiper during the course of outward wiper movement, a cooperating idler or "tap" roll 44 is supported above sheet level on a lever 45. The tap roll is swung, by a cam and follower 46, between a lower position (FIG. 1) in which it presses the sheet against the wiper and an upraised position (FIG. 2) in which the sheet is freed from the wiper after the wiper has performed its function. The wiper mechanism has a mechanical connection 47 to the timed driving assembly 28, with rotation being transmitted to the tap roll cam via a shaft 48. The term "wiper" has been employed for convenience but it will be understood that the term is intended in a general sense to include any mechanism for engaging the lateral edge of a sheet and for urging it toward the side guide 40 regardless of whether there is relative slippage.

In accordance with the present invention swingable suckers are provided laterally spaced below sheet level and having means for swinging them in unison about an arcuate path synchronized with the arrival of the sheet to be positioned, so that such sheet is transported forwardly in the direction of the front stops and laterally from its position in the stream into the zone of the wiper. Thus the wiper acts exclusively on the sheet to be positioned unaffected by the following, overlapped, sheet in the stream. In the present instance a pair of sucker mechanisms 50 are provided which are of identical construction, being shown in simplified form in the plan view of FIG. 3 and with the linkage of a preferred form of the invention being diagrammatically illustrated in FIGS. 5*a* and 5*b*. The mechanism 50 includes a sucker head 51 mounted upon an arm 52 which is pivoted for swinging movement about a central shaft 53. Means are provided for swinging the arm through an arc of substantially 90° between positions I and II upon arrival of a sheet, and with vacuum being applied to the head during the arc of movement. The shaft 53 has a mechanical connection 54 to the timed driving assembly 28, the speed and radius of swing being such that when the vacuum head engages a sheet at position I it is travelling, in the forward direction, at substantially conveyor speed thereby taking over control of the sheet from the conveyor free of any abrupt change in sheet velocity. However, because of the sinusoidal type variation in the forward velocity component as the sucker head swings through an arc of approximately 90°, into position II, the forward component of velocity is reduced to substantially zero, bringing the leading edge of the sheet into engagement with the front stops so that the sheet is momentarily stationary just prior to release of the front stops 30 and gripping of the leading edge of the sheet by the gripper arms 21.

Conventional means may be employed for applying vacuum at position I and removing vacuum at position II. Such means may be in the form of a valve 55 coupled to a "source" of vacuum 56, the valve having a mechanical connection 57 with the drive 54 for the sucker arms.

It will be apparent to one skilled in the art that various linkages may be used for swinging each sucker head 51 between its respective positions. A preferred form of linkage, illustrated in FIG. 5*a*, and indicated at 60, utilizes a modified parallelogram consisting of arms 61, 62 and a lever 63, the lever 63 being extended and carrying at its outer end a roller 64 which rides on the periphery of a fixed cam 65. The arm 61 has a drive connection with the shaft 53, while the arm 52 has a lost motion connection therewith. Thus in operation, when the arm 61 is rocked in a counterclockwise direction, for example, into the position shown in FIG. 5*b*, the arms and levers which make up the linkage undergo programmed movement in accordance with the profile of the fixed cam. It will be apparent that by controlling the shape of the cam and the proportions of the linkage the orbital velocity of the sucker can be varied as desired, but in any event such orbital velocity should approximate the conveyor speed in position I and should be substantially zero at position II.

In accordance with one of the more detailed features of the present invention the diameter of the suckers 51 is limited, preferably not exceeding an inch or two so that each sucker, in addition to adhering the undersurface of the sheet is easily rotatable with respect to the sheet, serving as a point of pivoting and with application of minimum "twist" to the sheet as the sucker head moves between its respective positions. Alternatively, the sucker head may be mounted in freely pivoting fashion on its supporting arm 52.

In accordance with an important feature of the present invention the incoming stream of shingled sheets is laterally spaced from the side guide 40 sufficiently to be out of the zone of action of the wiper. The lateral swing of the suction heads between their initial and final positions serves to move the engaged sheet into the zone of action of the wiper so that the wiper acts exclusively on each sheet free of interference by the following sheet in the stream. By "zone of action" is meant the distance, measured inwardly from the side guide 40, over which the wiper is effective to engage the lateral edge of a sheet and which is indicated at ZA in FIG. 3.

In carrying out the invention the lateral spacing of the stream of sheets from the side guide, indicated at S in FIG. 3, is so related to the width ZA of the zone of action and the lateral throw of the suction heads that the lateral edge of the engaged sheet enters the zone of action sufficiently ahead of the time that the suction head reaches its final position so that the wiper may complete its function in advance of engagement of the leading edge of the sheet with the front stops. As illustrated in FIG. 3, the position of the sucker head 51, corresponding to entry of the sheet into the zone of action of the wiper, is substantially at the point P. This insures that the leading edge of the sheet will not be drawn laterally while in contact with the front stops. In achieving this condition it is desirable for the wiper to have reasonably rapid action, nonetheless the wiper is not critical of adjustment. Being out of the way, laterally, from the following sheet in the stream, the wiper is free of interference by the following sheet. This is to be contrasted with conventional positioning arrangements in which the wiper must totally complete its function, and be restored to inactive position, well ahead of the arrival of the next sheet of the series.

The operation, therefore, may be summarized as follows: The stream of shingled sheets flows along the feed table spaced inwardly from the side guide and out of the zone of action of the wiper. As a sheet, for example the sheet indicated at 11 in FIG. 1, approaches the forward end of the feed table, the suction heads 51 are energized by vacuum and swung forwardly, at an initial speed corresponding to conveyor speed, from position I to position II. This causes the sheet to be transported forwardly and simultaneously decelerated. It also causes the sheet to move laterally through position 1*a*. When, upon continued movement, the suction head 51 reaches the point P, the lateral edge of the sheet is at the threshold of the zone of action ZA of the wiper 41. Thus control of the sheet, as far as lateral movement is concerned, is "taken over" by the wiper causing the sheet to be promptly lodged against the side guide 40 in position 1*b*. Upon movement of the suction head beyond point P and into final position the leading edge of the sheet is positioned against the front stops, with the velocity of the sheet having been reduced to zero. Because of the impositive connection between the vacuum head and the sheet, as compared to the slightly more positive engagement by the wiper, a slight amount of lateral shift may occur between the suction head and the sheet due to wiper action.

It is preferred to use a pair of sucker assemblies in order to insure that the engaged sheet is translated free of skew, but it will be apparent that additional, and identical, assemblies may be used in lateral alignment therewith without departing from the invention.

Figure 2:
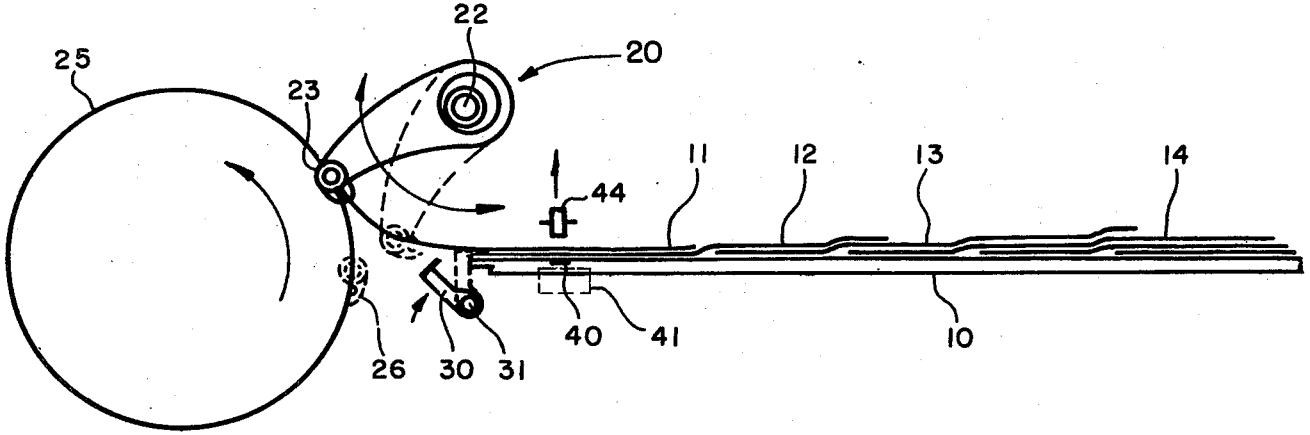
FIG. 2 is a stop motion view, similar to FIG. 1, showing transfer of a sheet to the impression cylinder.

After the sheet has been seated against the front stops 30 and the side guide 40, the front stops are released as shown in FIG. 2 and the grippers at the ends of the gripper arms engage the leading edge of the sheet, transferring such leading edge to the grippers 26 on the impression cylinder. During the time that the first sheet is being removed, the vacuum is released from the suctions heads and the suction heads are restored to initial position in readiness for engaging the next sheet in the series, following which the process is repeated.

While the invention has particular utility in individual transfer of overlapped sheets from a feed table to the impression cylinder of a printing press, it will be apparent to one skilled in the art that the sheet positioning mechanism is of general utility and that the term "press" includes a printing press or equivalent receiving means. The arrangement is inherently advantageous since it enables use of mechanisms associated with the front stops and side guide which are "covered," that is, which are located below the sheet feed path, a position which is out of the way and reduces maintenance to a minimum.

What we claim is:

1. A sheet positioning mechanism for the feed table of a sheet-fed printing press comprising, in combination, a set of releaseable front stops at the front edge of the feed table, a side guide at the side edge of the feed table, wiping means adjacent to the side guide for engaging a sheet which is to be positioned and urging it against the side guide, said wiping means having a limited zone of action, conveyor means for feeding sheets in shingled relation in a straight stream along the feed table, the stream being laterally spaced from the side guide sufficiently to be out of the zone of action of the wiping means, a pair of swingable suckers near the front end of the table and laterally spaced below the sheet path, means for swinging the suckers in unison about an arcuate path synchronized with the arrival of the sheet to be positioned so that such sheet is transported (a) forwardly in the direction of the front stops and also (b) laterally from its position in the stream into the zone of action of the wiping means so that the wiping means acts exclusively on the sheet to be positioned free from interference of the wiping means by the following sheet in the stream.

2. The combination as set forth in claim 1 in which the suckers are in the form of small diameter sucker heads mounted on respective horizontally swingable arms for orbital movement in unison with one another.

3. The combination as set forth in claim 2 in which the sucker heads engage a sheet at substantially conveyor speed and disengage the sheet at a point of zero forward speed so that the sheet incident to its engagement is smoothly declerated into temporarily stationary position against the front stops.

4. The combination as set forth in claim 1 in which the engaged sheet is moved into the zone of action of the wiping means in advance of the end of the arcuate path so that the wiping means may complete its action upon the sheet in advance of engagement of the leading edge thereof with the front stops.

5. A sheet positioning mechanism for the feed table of a sheet-fed printing press comprising, in combination, a set of releaseable front stops at the front edge of the feed table, a side guide at the side edge of the feed table, wiping means adjacent to the side guide for engaging a sheet which is to be positioned and urging it against the side guide, said wiping means having a limited zone of action, conveyor means for feeding sheets in shingled relation in a straight stream along the feed table, the stream being laterally spaced from the side guide sufficiently to be out of the zone of action of the wiping means, an auxiliary transport device near the front end of the table below the sheet path engageable with and sychronized with the arrival of the sheet to be positioned for transporting the sheet (a) forwardly in the direction of the front stops and (b) laterally from its position in the stream into the zone of action of the wiping means so that the wiping means acts exclusively on the sheet to be positioned free from interference of the wiping means by the following sheet in the stream.

6. A sheet positioning mechanism for the feed table of a sheet-fed printing press comprising, in combination, a set of releaseable front stops at the front edge of the feed table, a side guide at the side edge of the feed table, a wiper mechanism adjacent to the side guide for engaging a sheet which is to be positioned and urging it against the side guide, said wiper mechanism lying below the sheet path and having a limited zone of action, conveyor means for feeding sheets in shingled relation in a straight stream along the feed table, the stream being laterally spaced from the side guide sufficiently to be out of the zone of action of the wiper mechanism, a pair of swingable suckers near the front end of the table and laterally spaced below the sheet path, means for swinging the suckers in unison about an arcuate path synchronized with the arrival of the sheet to be positioned so that such sheet is transported (a) forwardly to the front stops and also (b) laterally from its position in the stream into the zone of action of the wiper mechanism so that the wiper mechanism acts exclusively on the sheet to be positioned, free from interference of the wiping means by the following sheet in the stream, the suckers having an initial forward speed component on the order of the conveyor speed and having a final forward speed component which is substantially zero.

7. A sheet positioning mechanism for a feed table of a sheet-fed printing press comprising, in combination, a set of releaseable front stops at the front edge of the feed table, a side guide at the side edge of the feed table, wiping means adjacent to the side guide for engaging a sheet which is to be positioned and urging it against the side guide, said wiping means having a limited zone of action, conveyor means for feeding sheets in shingled relation in a straight stream along the feed table, the stream being laterally spaced from the side guide sufficiently to be out of the zone of action of the wiping means, a pair of swingable suckers near the front end of the table and laterally spaced below the sheet path, means for swinging the suckers in unison about an arcuate path of substantially 90° synchronized with the arrival of the sheet to be positioned so that such sheet is transported (a) forwardly in the direction of the front stops and (b) laterally from its position in the stream into the zone of action of the wiping means so that the wiping means acts exclusively on the sheet to be positioned, free from interference of the wiping means by the following sheet in the stream.

8. A sheet positioning mechanism for a feed table of a sheet-fed printing press comprising, in combination, a set of releaseable front stops at the front edge of the feed table, a side guide at the side edge of the feed table, wiping means adjacent to the side guide including means for engaging the underside of a sheet which is to be positioned and urging it against the side guide, said wiping means having a limited zone of action, conveyor means for feeding sheets in shingled relation in a straight stream along the feed table, the stream being laterally spaced from the side guide sufficiently to be out of the zone of action of the wiping means, a pair of swingable suckers near the front end of the table and laterally spaced below the sheet path, means for swinging the suckers in unison about an arcuate path synchronized with the arrival of the sheet to be positioned so that the sheet is transported both (a) forwardly in the direction of the front stops and (b) laterally from its position in the stream into the zone of action of the wiping means so that the wiping means acts exclusively on the sheet to be positioned, free from interference of the wiping means by the overlapped following sheet in the stream, the wiping means being sufficiently rapid as to move the sheet against the side guide just prior to engagement of the sheet with the front stops.

9. The combination as claimed in claim 1 in which the sucker heads have an orbital velocity of substantially conveyor speed at the time of engagement decreasing to an orbital velocity of substantially zero at the time of disengagement.

10. The combination as claimed in claim 5 in which the auxiliary transport device is in the form of a pair of laterally spaced suckers having means for moving in unison and in which the forward velocity of the suckers is such as to engage a sheet at a speed which is substantially synchronized with the conveyor speed and in which both the forward and lateral velocity of the suckers at time of disengagement is substantially zero.

* * * * *